United States Patent [19]

Wells et al.

[11] Patent Number: 4,543,473

[45] Date of Patent: Sep. 24, 1985

[54] IMMERSION HEATER AND THERMOSTAT UNIT

[76] Inventors: Robert M. Wells, 4371 Ira Rd., Akron, Ohio 44313; Alton R. Wells, 4573 W. Trade Winds, Lauderdale by the Sea, Fla. 33308

[21] Appl. No.: 582,930

[22] Filed: Feb. 23, 1984

Related U.S. Application Data

[63] Continuation-in-part of Ser. No. 412,529, Aug. 30, 1982, abandoned.

[51] Int. Cl.[4] ..... H05B 3/06

[52] U.S. Cl. ..... 219/523; 219/331; 219/335; 219/441; 219/533; 219/542; 219/546

[58] Field of Search ..... 219/205, 318, 328, 331, 219/335, 437, 441, 444, 516, 523, 533, 541, 542, 544, 546, 552, 553; 338/229, 238, 239, 240, 241, 242; 29/614; 210/169

[56] References Cited

U.S. PATENT DOCUMENTS

| | | | |
|---|---|---|---|
| 2,372,212 | 3/1945 | Levin | 338/229 X |
| 2,864,929 | 12/1958 | Schwing | 219/523 |
| 2,888,547 | 5/1959 | Saper | 219/523 |
| 3,137,786 | 6/1964 | Wells et al. | 219/441 |
| 3,277,277 | 10/1966 | Wells | 219/523 X |
| 3,303,327 | 2/1967 | Himelsbaugh | 219/523 |
| 3,767,898 | 10/1973 | Wells et al. | 219/441 |
| 4,107,514 | 5/1978 | Ellson | 219/523 |
| 4,234,785 | 11/1980 | Lefebvre | 219/523 |
| 4,234,786 | 11/1980 | Borom | 219/544 |

*Primary Examiner*—Volodymyr Y. Mayewsky
*Attorney, Agent, or Firm*—Oldham, Oldham & Weber Co.

[57] ABSTRACT

An electric heater for insertion into a small container and comprising a heater core, a heater can having one closed and one open end in which the heater core is operatively embedded, a heater coil carried by said heater core only on a portion thereof adjacent the closed end of the can, a thermostat extending transversely of said heater core adjacent the open end of the heater can, the thermostat being insulated from the heater core.

6 Claims, 3 Drawing Figures

IMMERSION HEATER AND THERMOSTAT UNIT

This application is a continuation-in-part of my prior application Ser. No. 412,529, filed Aug. 30, 1982, now abandoned.

TECHNICAL FIELD

This invention relates to electrical heaters for small appliances and particularly to an electric heater-thermostat combination provided as a power pack unit for controlled heat supply to a small quantity of liquid in an associated container.

BACKGROUND ART

There have been various types of electric heater devices provided for a variety of functions and one use of electric heater units is for heating the water in the beverage producer such as coffee pots, coffee percolators, and the like. A prior patent of ours, U.S. Pat. No. 3,767,898 shows one commercial type of an electric heater that has been particularly satisfactory in functioning effectively and efficiently for heating the liquid contents of containers to desired steaming temperatures. That heater included a high limit cut off thermostat positioned internally of the heater case. This prior unit functions to supply heat to the particular appliances when predetermined elevated temperatures above boiling are reached.

These prior units have had the characteristics that the temperature provided by the electric heater will raise the contents of the electrical appliance to boiling, then the thermostat would open only after all the water has boiled away and the heater then begins to heat rapidly to run away temperatures. In this manner, the thermostat prevents dry operation at elevated temperatures and thus protects the plastic components.

The prior patent relates to a steamer unit such as a clothes steamer while the present invention relates to a hot beverage maker.

In contrast, in some instances, especially when heating small quantities of water to produce coffee, cocoa or the like, it may be desired not to boil the water in the container as part of the beverage making process, and to provide controlled temperatures in the processed liquid.

DISCLOSURE OF THE INVENTION

The general object of the present invention is to provide an improved type of heater-thermostat unit for controlled heat supply to containers and the liquid contents thereof.

Another object of the invention is to provide a power pack formed of a heater and a control thermostat and wherein the thermostat can have a cutoff temperature relatively near the desired maximum temperature of the heater liquid.

Another object of the invention is to provide specialized types of insulation in association with the heater-thermostat control power unit wherein the thetmostat is effectively and fully insulated from direct heat flow from the heater core and coil, including the hollow center thereof, to the thermostat; wherein the thermostat is physically spaced from the heater coil. Furthermore, the heater coil is positioned adjacent one end of the heater case and the thermostat is positioned adjacent the opposite end of the heater case to be axially spaced from the heater coil in the heater-thermostat assembly whereby the thermostat can be used to measure more accurately and positively the temperature of a liquid in which the heater case is immersed for liquid heating action.

Yet another object of the invention is to provide an improved, rapidly controllable heater-thermostat unit that has good heat supply control properties, which is an efficient, practical commercial construction, which has good control characteristics, and which can be manufactured in large quantities with assured consistent results. It is possible to get one to operate as desired but infinitely more difficult to get thousands to operate consistently.

The foregoing and other objects and advantages of the invention which will be more apparent as the specification proceeds, are achieved by: an electric heater for insertion into a small container for heating the contents thereof and comprising a heater core having an open center, a heater can having one closed and one open end, said heater core being operatively embedded in said heater can to extend longitudinally thereof, said can being adapted to be positioned with its closed end down extending into a container to heat the contents thereof, a heater coil carried by said heater core only on a half of said heater core adjacent said closed end, a thermostat extending transversely of said heater core adjacent the open end of said heater can, insulation means within said heater can and core and filling said core from the closed end of said can, and an insulation sleeve enclosing said thermostat whereby the thermostat is insulated from heat in said heater core to measure more rapidly and accurately the temperature of a liquid in which the heater can is immersed.

BRIEF DESCRIPTION OF THE DRAWINGS

Attention is now particularly directed to the accompanying drawings, wherein.

When referring to corresponding numbers shown in the drawings and referred to in the specification, corresponding numerals are used to facilitate comparison therebetween.

BEST MODE FOR CARRYING OUT THE INVENTION

An electric heater adapted for insertion into a small container for heating liquid contents therein and which heater comprises a heater core having an open center, a heater can having one closed end and one open end, the heater core operatively embedded in the heater can to extend longitudinally thereof, and the can is adapted to be positioned with the closed end down and extending into the container to heat the contents thereof, and a suitable means being connected to the heater can to extend therefrom for engaging the upper lip of a container for support action thereon. A heater coil is carried by the heater core only on the half of the heater core which is adjacent extending the closed end of the can and a thermostat is positioned transversely of the heater core adjacent the open end of the heater can at the end of the heater core, insulation means are provided within the heater can and core to fill the core to the closed end of the can, and an insulation sleeve means totally encompasses the thermostat so as to insulate the thermostat from heat in the heater core and from direct conductive heat of the core and adapt the thermostat to measure more rapidly and accurately the temperature of a liquid in which the heater can is immersed, the thermostat being positioned at a vertical position within the heater to be between the top and bottom levels of liquid in the container.

Figure 1:
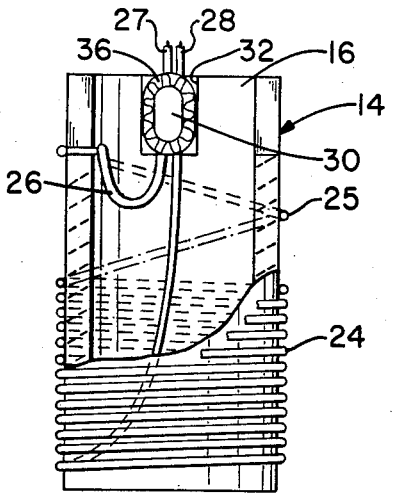
FIG. 1 is an elevation, partially broken away and shown in vertical section, of a heater core and heater coil unit embodying the principals of the invention.
Figure 2:
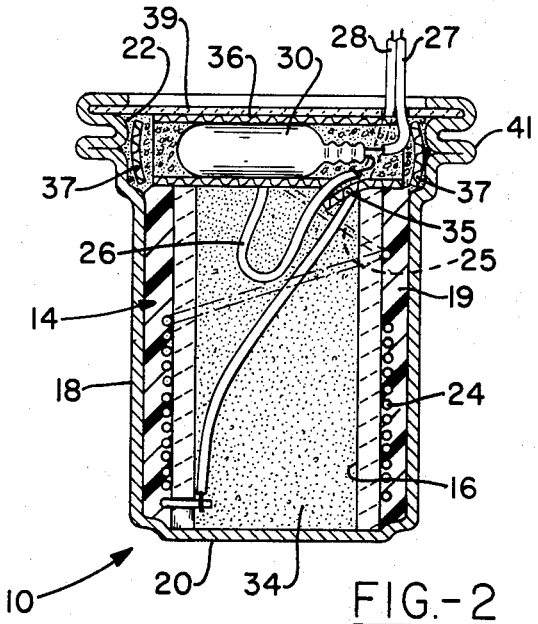
FIG. 2 is a vertical section through the heater coil of FIG. 1 as mounted operatively in a heater case in association with a thermostat.
Figure 3:
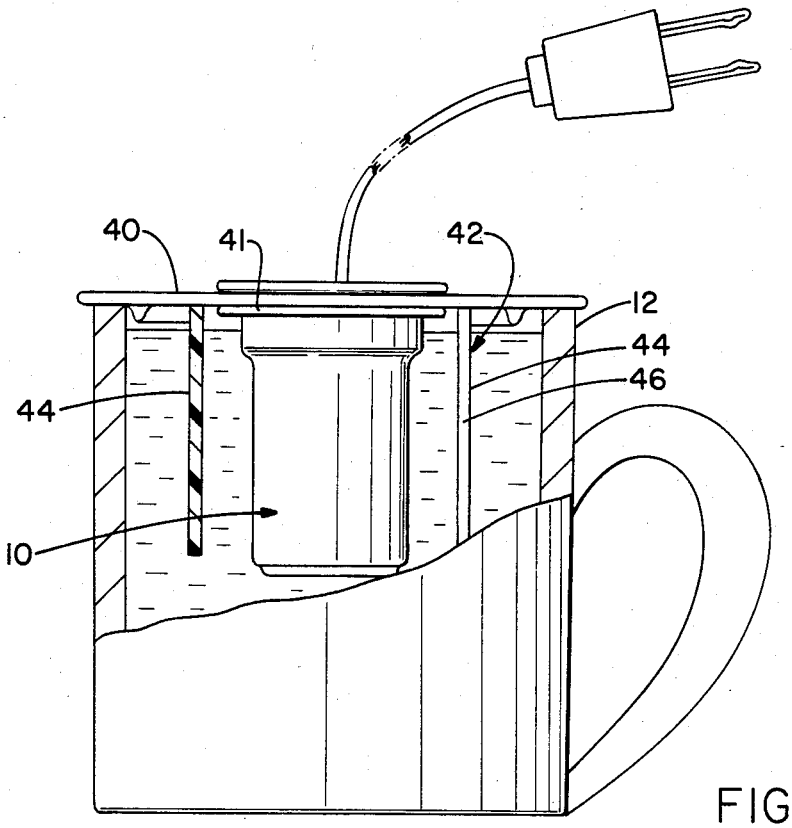
FIG. 3 is a fragmentary elevation, partially broken away of the heater-thermostat unit of the invention as operatively positioned in a container for heating the contents thereof.

Reference now is particularly made to the details of the construction shown in the drawings, and an electric heater is indicated as a whole by the numeral 10. As indicated in FIG. 3, this heater 10 is particularly designed to be positioned on the lip of a container 12 with the heater extending down into the container 12 to heat the liquid contents therein.

Specifically, the heater 10 includes a heater core 14 which has an open center 16 and which core is made from a conventional insulation material and the heater core is operatively positioned in a heater can 18. This can 18 has one closed end 20 and an open end 22. A heater wire coil 24 is provided on the heater core 14 but only on the half thereof that is positioned adjacent or at the closed end of the can 18. The coil 24 has suitable leads 26 and 28 extending therefrom.

This heater coil 24 and the core 14 are conventionally positioned in the heater can 18 by use of known positioning and electrical insulating means 19 such as magnesium oxide that is set up in place as a sleeve to hold the coil on the core and the core within the can 18. The insulation sleeve fills the space between the core 14 and the can 18, and conducts the heat to the can 18 and to the liquid in the container.

The coil 24 is positioned adjacent the lower end of the core and hence is adjacent the closed end of the can so as to be immersed totally in the liquid in the container to be heated. At the same time, this heater coil is physically and axially spaced from the control thermostat 30 that is preferably carried by or positioned on the core 14 adjacent the open end of the can as by being received in a diametrically extending slot 32 formed in the upper end of the heater core as the article is shown in the drawings.

So as to insulate the thermostat 30 in the best possible manner from any radiating heat effect or oven effect provided in the center of the core 14, preferably this core is filled loosely but fully with an insulating medium, such as foamed glass beads 34. These foamed beads form a spaced extra high efficiency thermal insulating medium. Such insulation medium extends the length of the core.

As a further insulation factor to protect the thermostat from heat generated within the heater can, an insulation sleeve 36 is positioned in a manner so that it totally envelopes the thermostat 30. Such thermostat 30 is of conventional metal case construction and the sleeve 36 is usually made from tightly woven high temperature, thermally insulating paper to provide a tube that can be slid into frictional contact with the thermostat and is retained in such position. One of the leads 26 connects to the thermostat and a second lead 27 extends therefrom outwardly of the can for use with the lead 28 to provide power supply thereto. The sleeve 36 has a flap 35 severed partly therefrom for the lead 26 to extend through but to leave the sleeve intact to enclose and extend beyond the thermostat 30.

As a further means for insulation within the heater 10, a mass of the foam glass bead, insulating means are positioned around the heater core 14 adjacent the open end of the heater can and to fill up around the thermostat and sleeve 36 to aid in insulating the entire unit to prevent heat radiating or flowing from the heater coil or the core 14, or from the heat conductive sleeve 19 to the thermostat by any ready flow path.

FIG. 3 shows that any desired positioning plate or unit can be used in association with the metal heater 10 and thus a plastic support flange or plate 40 is suitably operably engaged with the heater unit and such positioning plate may include a plastic shroud or cylindrically shaped section 42 that extends downwardly from the base plate in the form of circumferentially spaced strips 44 of enclosure material with the slots between the strips extending upwardly in the unit to expose the upper end of the heater can adjacent the horizontal level of the thermostat 30 therein. Hence, water will flow to and from association with the periphery of the metal can 18 but any steam generated can readily flow out through slots 46 in the shroud unit. Hence, good circulation of water around the heater can can be obtained, and yet the heat flow to the thermostat can be controlled by insulation means internally of the metal heater to have it accurately measure and be controlled by the temperature of the liquid surrounding the thermostat. Furthermore, if desired, the metal can 18 can be made from stainless steel so as to slow down transmittal of heat from the closed end of the heater case which is heated to the open end of the heater case which carries the thermostat and is insulated from the heater unit.

In use, the new heater and thermostat unit of the invention has been able to provide a mean operating temperature of 215° F. plus or minus 5° F. for its maximum temperature in the thermostat cycle. The resultant temperature of water thus heated within a small container will stay about 185° F. although it can vary as much as from 175° to 200° F. but it will be retained in that operative area by the thermostat controlling power flow to the heater coil. In contrast, the thermostat and heater unit shown in U.S. Pat. No. 3,767,898, while it worked better than equivalent apparatus in prior art, it has had a much greater variation between the temperature of the heater can and the temperature of the water or liquid being heated. For instance, the thermostat will have a mean operating temperature of about 370° F., plus or minus 20°, and it will have the liquid heated to boiling temperature and even boils dry before the thermostat would cut off the heater action as a high limit safety only.

The combination of the present invention protects against any runaway heater action by the heater as well as its primary brew temperature control function.

In the construction of the invention, it is also important to have the lead 26, extending from one end of the heater coil to the thermostat, be physically positioned *away* from the core 14 so as not to absorb and transmit heat from it to the thermostat.

The thermostat of the invention usually would have its initial cut at a related water temperature of about 175° to 195° F. The unit may have an operating temperature range of 175° to 195° F. for the mean water temperature, but yet the operating temperature of the thermostat can be in the vicinity of 210° to 220° F. As previously indicated, the prior art has had a temperature variation of as much as 150° or more between the temperature of the water, and the actuating temperature of the control thermostat in the heater can.

The present invention is endeavoring to and does obtain what is considered to be a total isolation of the thermostat from the heat generated in the heater can. This enables the thermostat 30 to closely follow and be controlled by the temperature of the heated liquid. The use of stainless steel to form the heater facilitates this action, together with the spacing of the heat coil from the thermostat, the insulation foam glass beads in the core 14, insulation sleeve and beads around the thermostat, etc.

The heater 10 may have any suitable mounting plate or base like a plate or disc 40 which can mount the heater to extend up or down from the plate 40. The heater is for use in a container to heat a liquid therein. The heater 10 should be used with liquid surrounding it and the thermostat 30 is within the planes of the top and bottom of the surfaces of the liquid in the container. The heater 10 has a conventional end plate 39 and the heater is secured in position for use by any known means such as a protruding threaded mounting stud secured thereto that engages an anchoring plate on an opposite face of a mounting disc or a container bottom. The heater can extend up when positioned on the bottom of a container or down from a mounting member, as shown in FIG. 3. Flange 41 normally bears on a surface of the heater mounting member and the mounting stud extends through such member.

A high quality thermal insulation paper is used to make the sleeve 36, and electrical insulation pieces or sheets 37 are preferably placed between the can 18 and ends of the thermostat. The foam glass beads 34*a* usually surround such pieces 37.

An end convolution 25 is provided for the water coil to connect the primary heater coil to an end portion of the heater core for electrical connection thereto.

The primary heat generation, of course, is concentrated at the lower end of the core by the coil 24 in the unit as illustrated in the drawings. Such coil 24 occupies only about one half the length of the heater core and has for example, 25 convolutions therein.

The amount of heat generated by the connecting heater coil convolution 25 is minimal in relation to that generated in the primary coil 24 whereby it can be considered that the heater coil is concentrated or positioned solely in the lower one half of the heater unit as shown. The coil 25 extends to an end slot in the core 14 where a connector 26 connects to such connector. The ends slots can be formed in the core 14 conveniently and they provide ready conduits for the power leads from outside the core to inside it.

From the foregoing, it is believed that a novel and improved electric heater has been provided. This heater has especially adapted for heating small quanities of liquid and will provide an efficient, practical type of a small liquid heater. Thus it is submitted that the objects of the invention have been achieved.

While one complete embodiment of the invention has been disclosed herein, it will be appreciated that modification of this particular embodiment of the invention may be resorted to without departing from the scope of the invention.

What is claimed is:

1. An electric heater for use with a small container for heating the liquid contents thereof and comprising:

an electrically non-conductive heater core having an open center, a heat conductive metal stainless steel heater can having one closed and one open end, said heater core being operatively positioned in said heater can to extend longitudinally, thereof, said can being adapted to be positioned within a container to heat the contents thereof, a heater coil carried by said heater core on only a portion of said heater core immediately adjacent said closed end, a thermostat extending transversely of said heater core immediately adjacent the open end of said heater can and connecting to said heater coil, foam glass bead insulation means within said heater can and core and filling said core, and a paper insulation sleeve totally encompassing said thermostat and extending longitudinally beyond the same at each end whereby the thermostat is insulated from heat in said heater core to measure more rapidly and accurately the temperature of a liquid in which the heater can is immersed, said heater core having a pair of downwardly extending diametrically opposed slots formed in its upper end, said insulation sleeve encompassed thermostat being positioned in said slots and extending across the open center of said heater core.

2. An electric heater as in claim 1, where said thermostat is spaced longitudinally of the heater core from said heat coil a distance equal to one half the length of said heater core.

3. An electric heater as in claim 2, where said foam glass bead insulation means surrounding said insulation sleeve-thermostat assembly and extending into open ends of said insulation sleeve.

4. An electric heater as in claim 1 where means engage said initially open end of said can to close the same and to aid in operatively positioning said heater can, and electric insulation means between said thermostat and said heater can.

5. An electric heater as in claim 3, where means engage said initially open end of said can to close the same, and electric insulation means between the open ends of said insulation sleeve and said heater can, said last named electric insulation means having foam glass beads positioned therearound.

6. An electric heater as in claim 1 where said heater coil comprises about 25 convolution on about one half the length of said core adjacent said can closed end and one end convolution extending about one half the length of said core to an end slot in the opposite end of said core.

* * * * *